United States Patent [19]

Chu et al.

[11] Patent Number: 5,032,032

[45] Date of Patent: Jul. 16, 1991

[54] RIBBON CASSETTE RESPONSIVE TO RIBBON BREAKAGE

[75] Inventors: Mosi Chu, Setauket; Anthony Graziano, Bay Shore, both of N.Y.

[73] Assignee: Primages, Inc., Ronkonkona, N.Y.

[21] Appl. No.: 870,631

[22] Filed: Jun. 4, 1986

[51] Int. Cl.[5] ..... B41J 33/16

[52] U.S. Cl. ..... 400/234; 400/208

[58] Field of Search ..... 400/208, 234, 249; 242/75.3, 57

[56] References Cited

U.S. PATENT DOCUMENTS

| | | | |
|---|---|---|---|
| 3,873,045 | 3/1975 | Nemoto et al. | 242/75.3 |
| 4,401,394 | 8/1983 | Hume et al. | 400/249 |
| 4,544,291 | 10/1985 | Nagata et al. | 400/234 |

FOREIGN PATENT DOCUMENTS

| | | | |
|---|---|---|---|
| 157096 | 10/1985 | European Pat. Off. | 400/234 |
| 199680 | 12/1982 | Japan | 400/249 |
| 190868 | 10/1984 | Japan | 400/234 |

OTHER PUBLICATIONS

Smith, "Servo Controlled . . . Takeup Device", IBM Technical Disclosure Bulletin, vol. 18, No. 12, p. 4071, 5-76.

*Primary Examiner*—Edgar S. Burr
*Assistant Examiner*—C. A. Bennett

[57] ABSTRACT

A ribbon cassette including a casing provided with an opening for receiving a photoelectric device. In the casing is a ribbon which passes from a supply reel to a take-up reel. A guide leads the ribbon past the photoelectric device. If the ribbon breaks, the ribbon is pulled away from the photoelectric device to cause a change in received light.

10 Claims, 3 Drawing Sheets

FIG. 2A
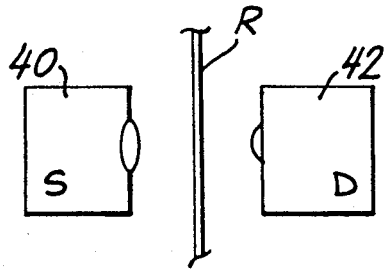
FIG. 2B
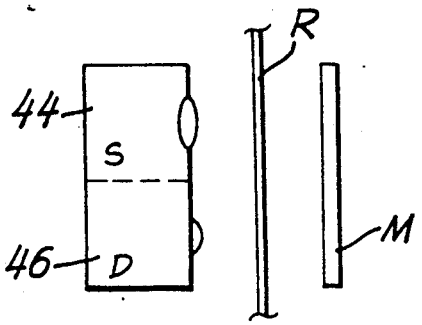
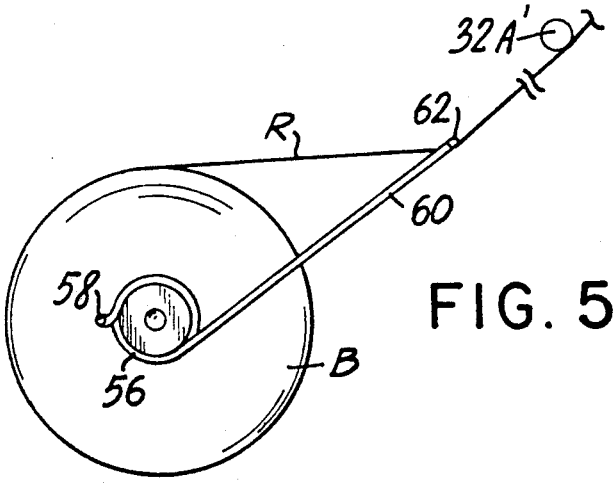
FIG. 5
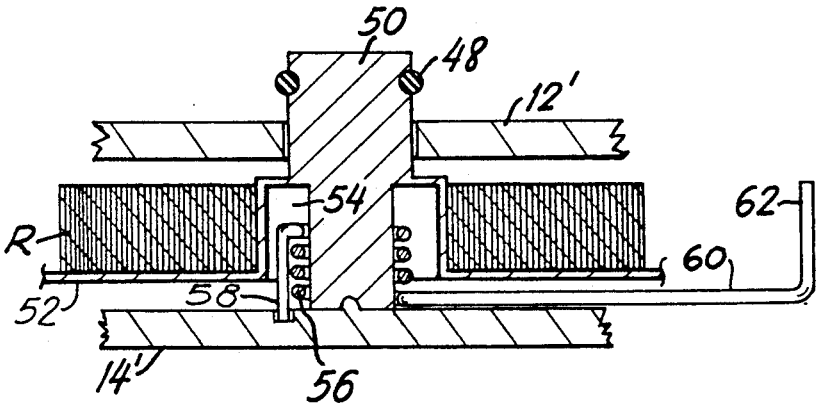
FIG. 6

RIBBON CASSETTE RESPONSIVE TO RIBBON BREAKAGE

BACKGROUND OF THE INVENTION

This invention pertains to ribbon cassette for printers and more particularly to ribbon cassettes that are responsive to ribbon breakage for giving indications of such breakage.

Many present day printers are driven unattended by computers. Manufacturers are aware of this fact and have included end-of-ribbon sensing. In general, the printer includes a photoelectric assemblage having a light source and a light detector which coact with the ribbon in the casette. The end of the ribbon has either a reflective or transmissive region depending on the assemblage. When a certain condition is sensed such as the presence of light by the detector, an indication is given that the end of the ribbon has come. This indication stops the printing operation. While the end-of-ribbon problem has been solved, the ribbon breakage problem has generally been ignored.

In addition to requiring reliability, generally, there is a desire for good print quality. Given good print elements, ribbons and record media, print quality depends on the tension of the ribbon while printing. Not only does good tension improve print quality, but it also facilitates the take-up of spent ribbon. Therefore, most cassettes include ribbon tensioning. Examples of such ribbon tensioning can be found in U.S. Pat. Nos. 4,367,052; 4,373,824; 4,010,839; and 4,368,992. These patents teach the use of complicated ratcheting schemes to produce such tension.

SUMMARY OF INVENTION

It is accordingly an object of the invention to provide inexpensive apparatus for detecting ribbon breakage.

It is another object of the invention to provide for such detecting using many of the elements present for end-of-ribbon sensing.

It is yet another object of the invention to provide inexpensive ribbon tensioning apparatus which at eh same time is used as part of the apparatus for providing ribbon breakage sensing.

Briefly, the invention contemplates a ribbon cassette removably mountable on a printing device which includes a driving shaft for driving the ribbons and a photoelectric means for giving signals when there is a change in the received light. The cassette includes, for example, a casing having a bottom portion and a top portion. There is a supply reel on which new ribbon is normally wound, and a supply reel shaft for rotatably supporting the supply reel within the casing between the top and bottom portions. There is also a take-up reel upon which spent ribbon is normally wound, a take-up reel shaft for rotatably supporting the take-up reel within the casing between the top and bottom portions. An outlet aperture is provided in the casing is and associated with the supply reel and an inlet aperture is also located in the casing and associated with the take-up reel. There is further provided an opening in the casing for receiving the photoelectric means. Guide means are employed for guiding the ribbon along a path from the supply reel via the outlet and inlet apertures to the take-up reel. In addition, the guide means further guides the ribbon in operative proximity to the photoelectric means. A take-up means connected to the driving member of the printer pull ribbon along such path in a first direction from the supply reel onto the take-up reel. Tension means connected to the supply reel shaft urges the ribbon to move along such path in a second and opposite direction so that if the ribbon breaks, the ribbon is pulled away from the photoelectric means whereby there is a change in the received light.

BRIEF DESCRIPTION OF THE DRAWING

Other objects, features and advantages of the invention will be apparent from the following detailed description when read in conjunction with the accompanying drawing, wherein:

FIG. 2 is an enlarged view of two embodiments of photoelectric assemblages for sensing for the condition of the ribbon within the cassette;

FIG. 5 is a bottom view of the supply reel and helical spring; and

FIG. 6 is a section view through the supply reel.

DETAILED DESCRIPTION OF PREFERRED EMBODIMENT OF THE INVENTION

Figure 1:
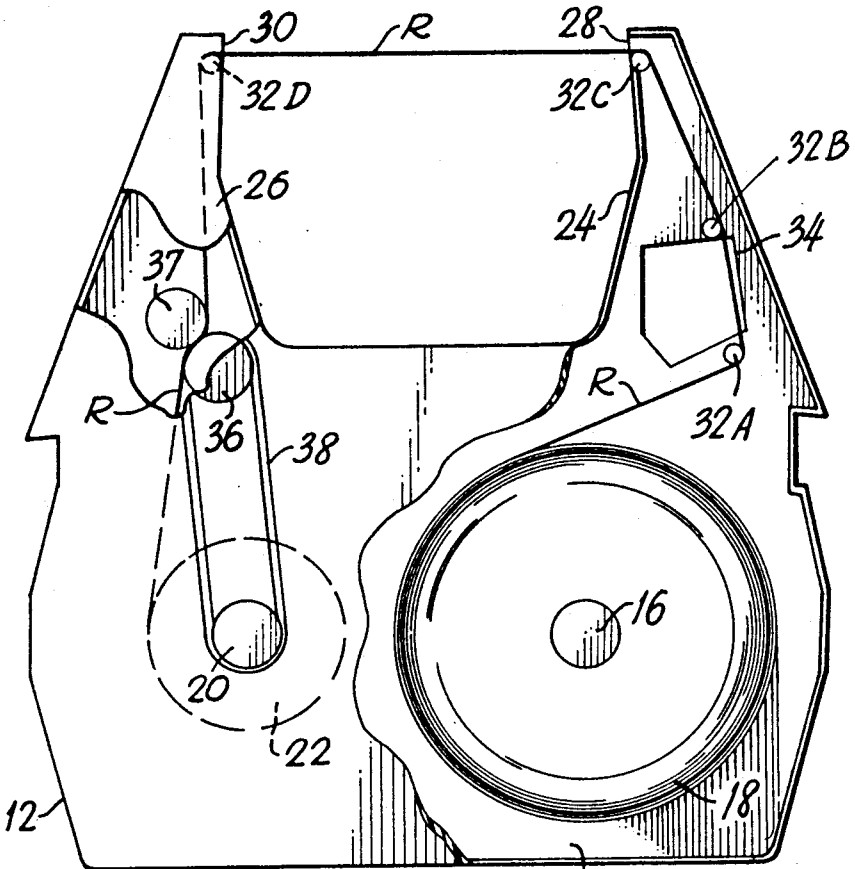
FIG. 1 PRIOR ART
FIG. 1 is a plan view of a prior art ribbon cassette with part of the top portion broken away.

In FIG. 1, there is shown a ribbon cassette 10 having a casing with a bottom portion 14 and a top portion 12 (partially broken away). A supply reel shaft 16 rotatably supports a supply reel 18 loaded with ribbon R for printing within the top and bottom portions of casing (associated with the supply reel 18 there is a complicated tension maintaining mechanism which forms no part of the invention and is consequently not shown). A take-up reel shaft 20 rotatably supports a take-up reel 22 within the top and bottom portions of the casing. At the end of the arms 24 and 26 are the outlet aperture 28 and inlet aperture 30. Within the casing are a plurality of posts 32 for guiding the ribbon R along a path from supply reel 18 via apertures 28 and 30 to take-up reel 22. (Note posts 32A and 32B guide the ribbon over opening 34 in the bottom portion 14. This opening 34 is for receiving a photoelectric assemblage hereinafter more fully described.) Finally, there is a driving shaft 36 whose top end is coupled by belt 38 of elastomeric material to take-up reel shaft 20. Opposite the central portion of the drive shaft 36, acting as a capstan, there is a pressure roller 37.

In operation, the cassette 10 is mounted on the carrier par of a printer (not shown). The exposed portion of the ribbon lies between the platen and a print wheel while the photoelectric assemblage passes through opening 34. In addition, the bottom or driving shaft 36 is engaged by a driving member of the printer. Thus, as the printer operates, shaft 36 is incrementally rotated counter clockwise. The ribbon between the shaft 36 and pressure roller 37 is pulled toward the take-up reel 22. In addition, the motion of the shaft 36 is transfered via belt 38 to shaft 20 causing ribbon R to be collected on take-up reel 22. This operation continues until the end of the ribbon is sensed.

The sensing is normally done in one of two ways. FIG. 2A shows the light transmission technique. In particular, the photoelectric assemblage includes a light source 40 and a light detector 42 straddling ribbon R. Near the end of the ribbon the opaque portion of the ribbon is provided with a transparent leader which is connected to the hub of reel 18. Thus when the transparent leader reaches the assemblage light passes from source 40 to detector 42 which gives an indication.

FIG. 2B shows the light reflection technique. The photoelectric assemblage includes the light source 44 and light detector 46 on the same side of the ribbon. The end of ribbon leader in this case is reflective. Thus, when the leader is opposite the assemblage, light from source 44 is reflected by the leader to detector 46 and an indication is given. In either case, broken ribbon does not activate the assemblage if any of the opaque ribbon lies in front of the assemblage.

Figure 3:
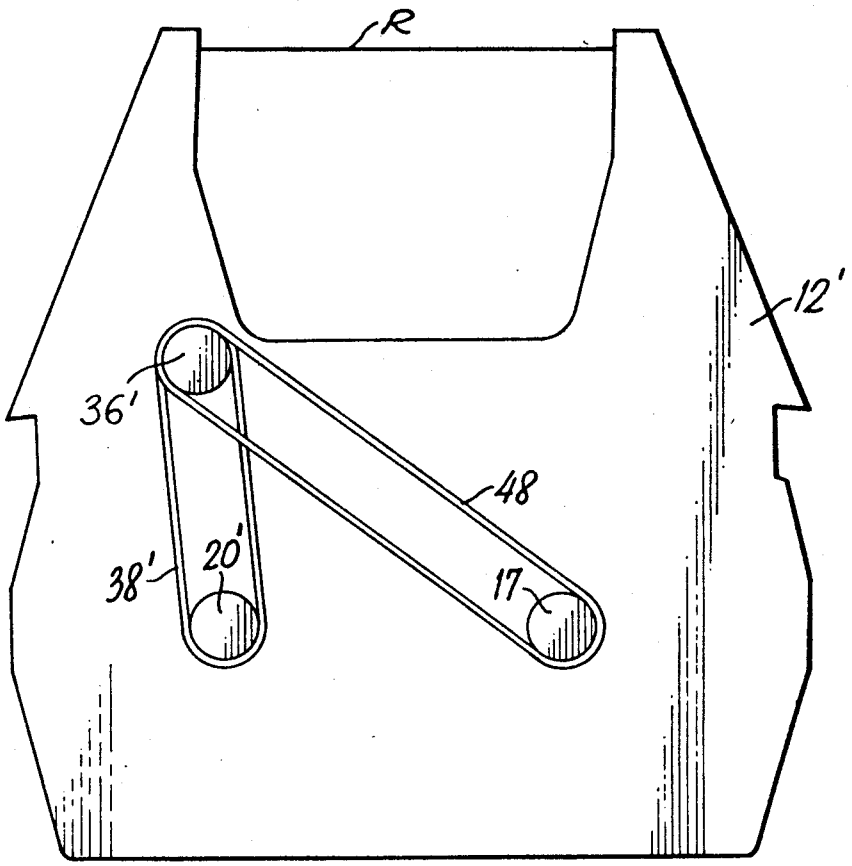
FIG. 3 is a top plan view of the ribbon cassette according to the invention.

In FIG. 3, there is shown a ribbon cassette 10' in accordance with a first embodiment of the invention. Since most of the elements are identical, primed reference characters are used and only the differences will be discussed. More specifically, the supply reel shaft 17 is elongated so as to extend through the top portion 12' of the casing. Similarly, driving shaft 36 is further elongated. A belt 48 of elastomer material couples the top end of driving shaft 36 to the top end of supply reel shaft 17.

In operation, as driving shaft 36 rotates counter clockwise, ribbon is pulled from the supply reel by the capstan-pressure roller combination and taken up by the take-up reel as before. (Note the pulling of the ribbon causes the supply reel to rotate clockwise-See FIG. 1.) In addition, belt 48 imparts a counter clockwise torque to shaft 17. The torque is less than the torque exerted by the ribbon being pulled by the capstan-roller combination so that the ribbon is pulled from the supply reel with some drag. Thus, the ribbon R is under tension.

Now if the ribbon breaks, the counter clockwise torque exerted by the belt 48 is unopposed and supply reel 16 winds back all ribbon "upstream" of the break. Eventually, there is no ribbon in the region of the photoelectric assemblage. If the assemblage is as shown in FIG. 2A, light is picked up by detector 42 and the indication is given. If a reflective technique is used then it is necessary to add the mirror M to the assemblage of FIG. 2B.

Figure 4:
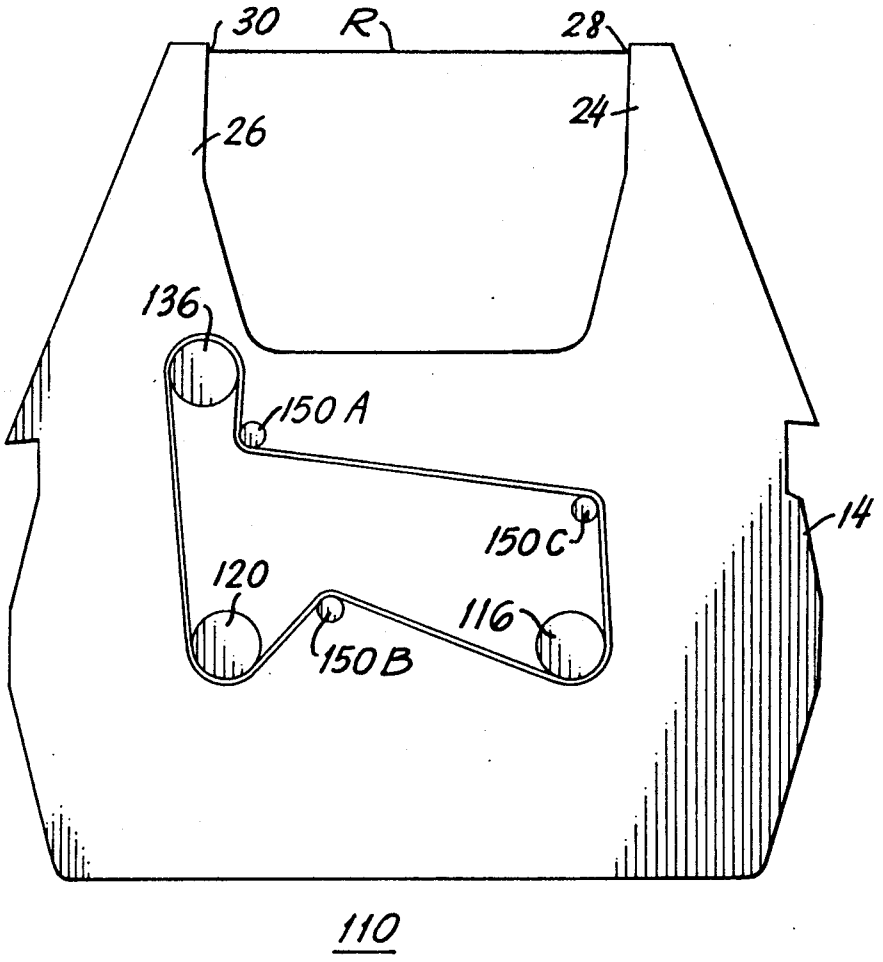
FIG. 4 is a top plan view of an alternate embodiment of the cassette of FIGS. 3.

An alternate embodiment of the tensioning concept is shown in FIG. 4 which is the same as the cassette of FIG. 3 except for the tensioning means. In particular, the cassette 110 has a similar driving shaft 136, a similar take-up reel shaft 120, and a similar supply reel shaft 116. A single belt B is wrapped about the three shafts. In order to insure that the slippage between belt B and shaft 116 is greater than the slippage between belt B and shaft 120 is greater than the slippage between belt B and shaft 136 posts 150A, B and C are provided to control the wrap angles (contact area) of the belt B about the shafts. The greater the wrap angle about a shaft the greater the friction, and the lower the slip. Thus, the wrap angle about shaft 136 is made greater than the wrap angle about shaft 120 which is greater than the wrap angle about shaft 116.

There is a time lag between the time of the ribbon break and the removal of the ribbon R from operative proximity of the photoelectric assemblage. The lag is a function of the position of the break. In many instances the time lag is unimportant. However, there may be times when an indication of the break should be as soon as possible. In such case, the spring concept shown in FIGS. 5 and 6 is advantageous.

The supply reel 52 is connected to shaft 50 which is driven by belt 48. There is a cylindrical well 54 between shaft 50 and reel 52. Disposed in the wall 54 is a helical spring 56 having a tab 58 anchored in bottom portion 14' of the casing. The other end of the spring has an arm 60. When the reel-ribbon assemblage is assembled, spring 56 is coiled under tension with a finger 62 upwardly extending from arm 60 to engage ribbon R which is also under tension as shown in FIG. 5.

If during operation the ribbon R breaks, spring 56 uncoils and finger 62 whips the free end of the ribbon around the reel 52; thus pulling ribbon clear of the photoelectric assemblage.

Although the rewinding operation by means of the spring 56 has been described in conjunction with a particular tensioning means, it should be noted it can be used with any ribbon tensioning means as well as in the absence of any tensioning means.

Although a limited number of embodiments have been shown and described in detail, there will now be obvious to those skilled in the art many modifications and variations which do not depart from the spirit of the invention as defined by the appended claims.

What is claimed is:

1. A ribbon cassette including a ribbon and removably mountable on a printing device which includes a driving member for driving the ribbon and a photoelectric means for giving signals when there is a change in the received light, the cassette comprising a casing having a bottom portion and a top portion, a supply reel on which new ribbon is normally wound, a supply reel shaft for rotatably supporting said supply reel within said casing between said top and bottom portions, a take-up reel upon which spent ribbon is normally wound, a take-up reel shaft for rotatably supporting said take-up reel within said casing between said top and bottom portions, an outlet aperture in said casing associated with said supply reel, an inlet aperture in said casing associated with said take-up reel, said casing being provided with an opening for receiving the photoelectric means, guide means for guiding the ribbon along a path from said supply reel via said outlet and inlet apertures to said take-up reel, said guide means further guiding the ribbon in operative proximity to the photoelectric means, a driving shaft connected to the driving member, take-up means driven by said driving shaft for pulling ribbon in the printing device along said path in a first direction from said supply reel onto said take-up reel and tensioning means connected to said supply reel shaft for urging the ribbon to move along said path in a second and opposite direction so that, if said ribbon breaks, the ribbon is pulled away from the photoelectric means whereby there is a change in the received light.

2. The ribbon cassette of claim 1 wherein said tensioning means is means for drivingly connecting the driving member of the printer to the supply reel shaft.

3. The ribbon cassette of claim 1 wherein said take-up means includes a first elastomeric belt drive connecting means and said tensioning means includes a second elastomeric belt.

4. The ribbon cassette of claim 3 comprising a pressure roller operatively associated with said driving shaft to constitute a pressure roller-driving shaft means for engaging the ribbon intermediate said reels and for driving said ribbon along said path in said first direction, said first elastomer belt drive connecting means and said second belt being coupled to said pressure roller driving shaft means and being driven by the same.

5. The ribbon cassette of claim 1 further comprising a helical spring disposed around said supply reel shaft under tension and having an arm member over which rides a portion of the ribbon between said supply reel and said outlet aperture for whipping an end of a broken tape around said supply reel.

6. In a ribbon cassette having in a casing, a take-up reel on a shaft and a supply reel on a shaft, means for guiding a ribbon in a path from said supply reel to said take-up reel, and means for maintaining the ribbon between the reels under tension, the improvement comprising sensing means for sensing for the presence of ribbon at an adjacent point int he path and a helical spring disposed around the shaft for the supply reel, said spring being under tension and having one end thereof anchored to the casing and another end being constituted as an arm means over which a portion of the ribbon rides to provide for whipping the ribbon in part around said supply reel upon breakage of the ribbon whereby the ribbon is displaced from said adjacent point in the path.

7. A ribbon cassette removably mountable on a printing device which includes a driving member for driving the ribbon and a photoelectric means for giving signals when there is a change in the received light, the cassette comprising a casing having a bottom portion and a top portion, a supply reel on which new ribbon is normally wound, a supply reel shaft for rotatably supporting said supply reel within said casing between said top and bottom portions, a take-up reel upon which spent ribbon is normally wound, a take-up reel shaft for rotatably supporting said take-up reel within said casing between said top and bottom portions, an outlet aperture in said casing associated with said supply reel, an inlet aperture in said casing associated with said take-up reel, said casing being provided with an opening for receiving the photoelectric means, guide means for guiding the ribbon along a path in a first direction from said supply reel via said outlet and inlet apertures to said take-up reel, said guide means further guiding the ribbon in operative proximity to the photoelectric means whereby the presence or absence of the ribbon can be detected, a driving shaft operably connected to the driving member of the printer, and elastomeric belt means connected to said take-up reel shaft and to said supply reel shaft for tending to pull the ribbon in a second direction from said take-up reel to said supply reel whereby if ribbon breakage occurs any portion of the ribbon that remains coupled to the supply reel will be wound back onto the same.

8. The ribbon cassette of claim 7 wherein said elastomeric belt means comprises a first belt drivingly connecting said driving shaft to said take-up reel shaft and a second belt drivingly connecting said driving shaft to said supply reel shaft.

9. The ribbon cassette of claim 7 wherein said elastomeric belt means comprises a single belt drivingly connecting said driving shaft to said supply reel shaft and said take-up reel shaft.

10. The ribbon cassette of claim 7 comprising a pressure roller operatively associated with said driving shaft to constitute a pressure roller-driving shaft means for engaging the ribbon intermediate said reels and for driving said ribbon along said path in said first direction, said elastomer belt means being coupled to said pressure roller-driving shaft means and being driven by the same.

* * * * *